United States Patent [19]

Chang

[11] Patent Number: 4,566,600

[45] Date of Patent: Jan. 28, 1986

[54] PLASTIC CONTAINER

[75] Inventor: Long F. Chang, Sylvania, Ohio

[73] Assignee: Owens-Illinois, Inc., Toledo, Ohio

[21] Appl. No.: 710,825

[22] Filed: Mar. 12, 1985

Related U.S. Application Data

[63] Continuation of Ser. No. 628,014, Jul. 5, 1984, abandoned.

[51] Int. Cl.[4] ..... B65D 23/00

[52] U.S. Cl. ..... 215/1 C

[58] Field of Search ..... 215/1 C

[56] References Cited

U.S. PATENT DOCUMENTS 4,352,435 10/1982 Yoshino et al. ..... 215/1 C
4,355,728 10/1982 Yoshino et al. ..... 215/1 C
4,368,825 1/1983 Motill ..... 215/1 C
4,465,199 8/1984 Aoki ..... 215/1 C

*Primary Examiner*—Joseph Man-Fu Moy
*Attorney, Agent, or Firm*—Philip M. Rice

[57] ABSTRACT

A plastic container is disclosed comprising an upper threaded finished portion, an outstanding handling ledge below the finished portion, a neck portion below the outstanding handling ledge, a concave blending portion below the neck portion and a main body portion below the concave blending portion. The main body portion includes an upper convex shoulder portion, an intermediate cylindrical main sidewall portion and a terminal spherical bottom portion. The container includes a reduced concave blending portion, reduced overall container weight and highly uniform, oriented main body portions.

11 Claims, 2 Drawing Figures

PLASTIC CONTAINER

This is a continuation of application Ser. No. 628,014 filed July 5, 1984, now abandoned.

BACKGROUND OF THE INVENTION

1. Field of the Invention

The present invention relates to the design of pressurized plastic containers useful for storing carbonated beverages.

A container for carbonated beverages generally consists of a finish portion with a handling ledge which blends into a neck portion of the container. The neck portion blends into the main body of the container which may assume various configurations. Presently known containers are relatively high in weight which adds cost to their production. Similarly, presently available containers suffer from nonuniform orientation of the plastic in the main body portion of the container. Such nonuniform orientation produces lower barrier properties and lower thermal stability than needed for many applications which require long shelf life and high mechanical strength of the overall container.

2. Description of the References

In the past, many methods for fabricating organic thermoplastic, oriented containers have been used. Similarly, many designs for containers are known in the art.

For example, U.S. Pat. No. 4,153,667 to Brady et al. discloses a method for enhancing the yield strength and density of an oriented plastic container wherein the material is susceptible to strain-hardening. The plastic material is thermally preconditioned to a temperature within the molecular orientation range and is then mechanically conditioned by stretching in a first direction to a length between 2.6–2.7 times its original length. Subsequently, the plastic material is stretched in a second direction, with strain-hardening and strain-induced crystallization thereby increasing drastically, substantially immediately, upon the initiation of the second stretching operation due to the mechanical conditioning by elongation during the first stretching operation.

Another method for conditioning strain-hardenable thermoplastic materials for fabricating containers is disclosed in U.S. Pat. No. 4,144,298 to Lee. The Lee patent discloses a method of conditioning strain-hardenable thermoplastic materials so that a highly developed strain-crystallized morphology is established during the blow molding operation. In this method a thermoplastic parison is heated to a temperature in the range conductive to molecular orientation and then initially stretched at that temperature. Next, the stretched parison is cooled to a temperature slightly below the glass transition temperature of the plastic and stretched further at the reduced temperature. The combined stretching at the two separate phases conditions the material such that it is either on the verge of being strain-hardened or is actually strain-hardened before any further processing.

Another approach to container manufacture is disclosed in the patent to Farrell, U.S. Pat. No. 3,972,976. The Farrell patent discloses a method for the longitudinal stretching of a parison to be blow molded. The Farrell method includes a special provision for maintaining the plastic of the parison on a blow molding machine's core rod at the orientation temperature of the plastic, and stretching the plastic of the parison lengthwise of the core rod. The lengthwise stretching of the parison in the direction of one axis without substantial increase in the diameter of the parison occurs. After this orientation in one axis has occurred, the temperature is controlled to maintain an orientation temperature. Next, the plastic of the parison is blown to a larger diameter so as to obtain orientation in the second direction. The resultant container is biaxially oriented.

Another approach to container manufacture is disclosed in the patent Agrawal et al., U.S. Pat. No. 4,131,666, which discloses a method for forming molecularly oriented containers from reheated parisons. The method includes heating the parisons to orientation temperature followed by distention to container form in a closed mold. The resultant container includes improved reduced thickness variability in lower portions of the container which result from controlling preformed shrinkage in the heating step of between 4–15 percent of the initial length of the material. This is achieved by maintaining the ratio of average thickness to inside parison surface area within defined limits. The preforms are then axially and radially stretched during the distention to the predetermined level.

Among the objectives of the present invention are the provision of a novel container structure for a container fabricated from orientable, strain-hardenable, organic, thermoplastic materials, which includes a number of advantageous features. The container according to the present invention is extremely lightweight compared to commercially available containers used for holding similar volumes. Further, the container according to the present invention has highly oriented, very uniform sidewalls which provide superior barrier properties and high thermal stability yielding long shelf life and high mechanical durability. Further, the present container provides for a limited concave blending portion between the neck of the container and the shoulder portion of the main body of the container.

More specifically, the container according to the present invention provides for highly efficient material distribution to achieve a uniform, highly oriented sidewall in the main body portion of the container. Also, limited concave surface area on the container is achieved. The minimization of concave surface area is advantageous to lower such surface area which is subject to very high stress due to constant forces exerted upon such concave surface areas by internal carbonation pressure. Upon long exposure to such internal pressure the highly stressed concave positions of the container develop stress cracking. Such stress cracking lowers the mechanically stability of the neck portion of the container.

Additionally, the container according to the present invention exhibits high stretch ratios in the main body portions of the container to achieve significant high levels of orientation with the above described advantages. Further, the container according to the present invention includes minimal surface area for a predefined volume to most efficiently approximate a spherical configuration. The minimal surface to volume ratio produces a superior container with lower gas transmission rates, and thus higher shelf life than commercially available containers.

SUMMARY OF THE INVENTION

An oriented, organic thermoplastic container for storing carbonated beverages under pressure is disclosed including an upper threaded finish portion which blends into an outstanding handling ledge. A container neck portion is disposed below and integral with the lowermost portion of the outstanding handling ledge and blends into a reduced surface area concave blending portion. A main body of the container, including an upper convex shoulder portion, a centrally located, cylindrical main sidewall portion and a spherical bottom portion, blends with the reduced area concave blending portion to complete the oriented, organic, thermoplastic container of the present invention. The container is defined by key structural relationship ratios which define a highly material effficient, low weight, minimal concave surface area container. The novel container of the present invention exhibits highly efficient use of material due to maximized stretch ratios and maximized orientation of the plastic. The container further defines a minimum surface to area of volume ratio for reduced gas transmission and increased shelf life.

BRIEF DESCRIPTION OF THE DRAWINGS

The above advantages of the container according to the present invention will become readily apparent to one skilled in the container art from reading the following detailed description of the preferred embodiments of the invention, when considered in view of the accopanying drawings, in which.

DESCRIPTION OF THE INVENTION

Figure 1:
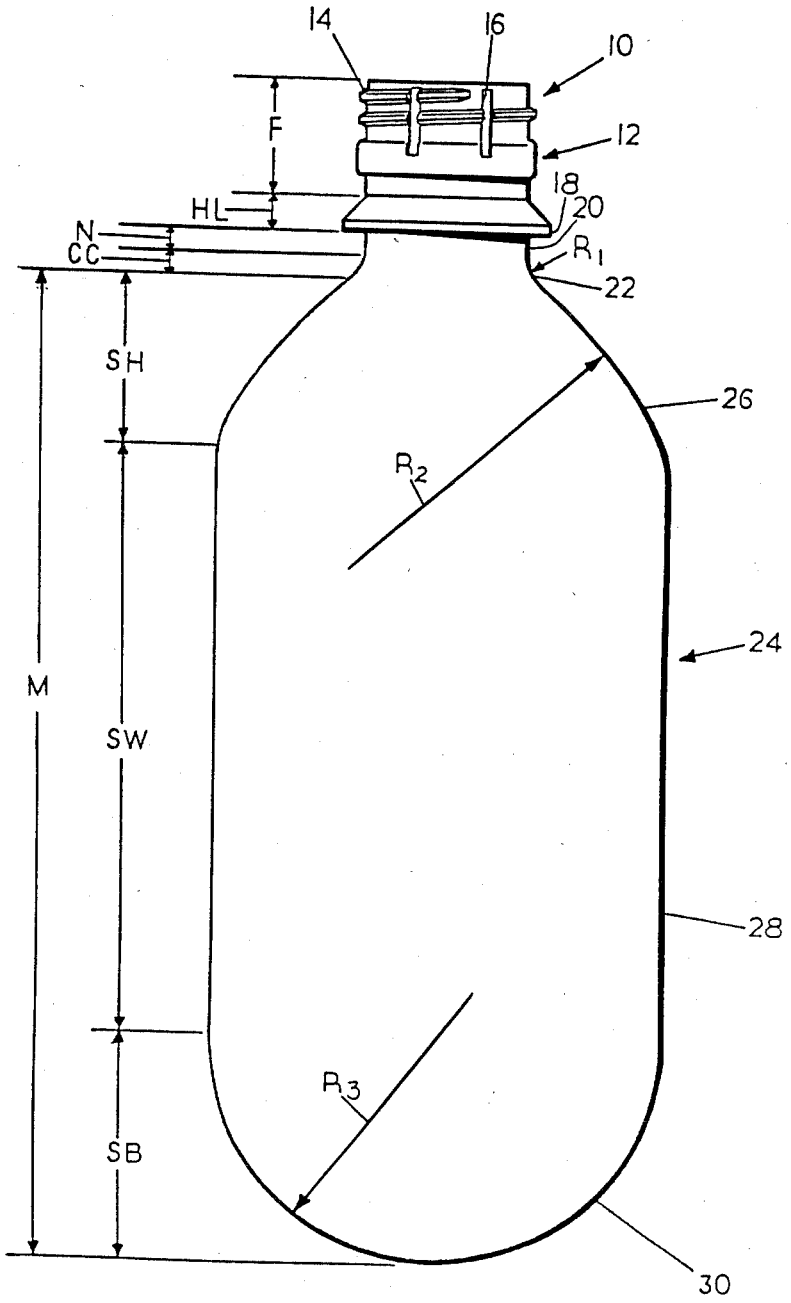
FIg. 1 is an elevational view of the container according to the present invention.
Figure 2:
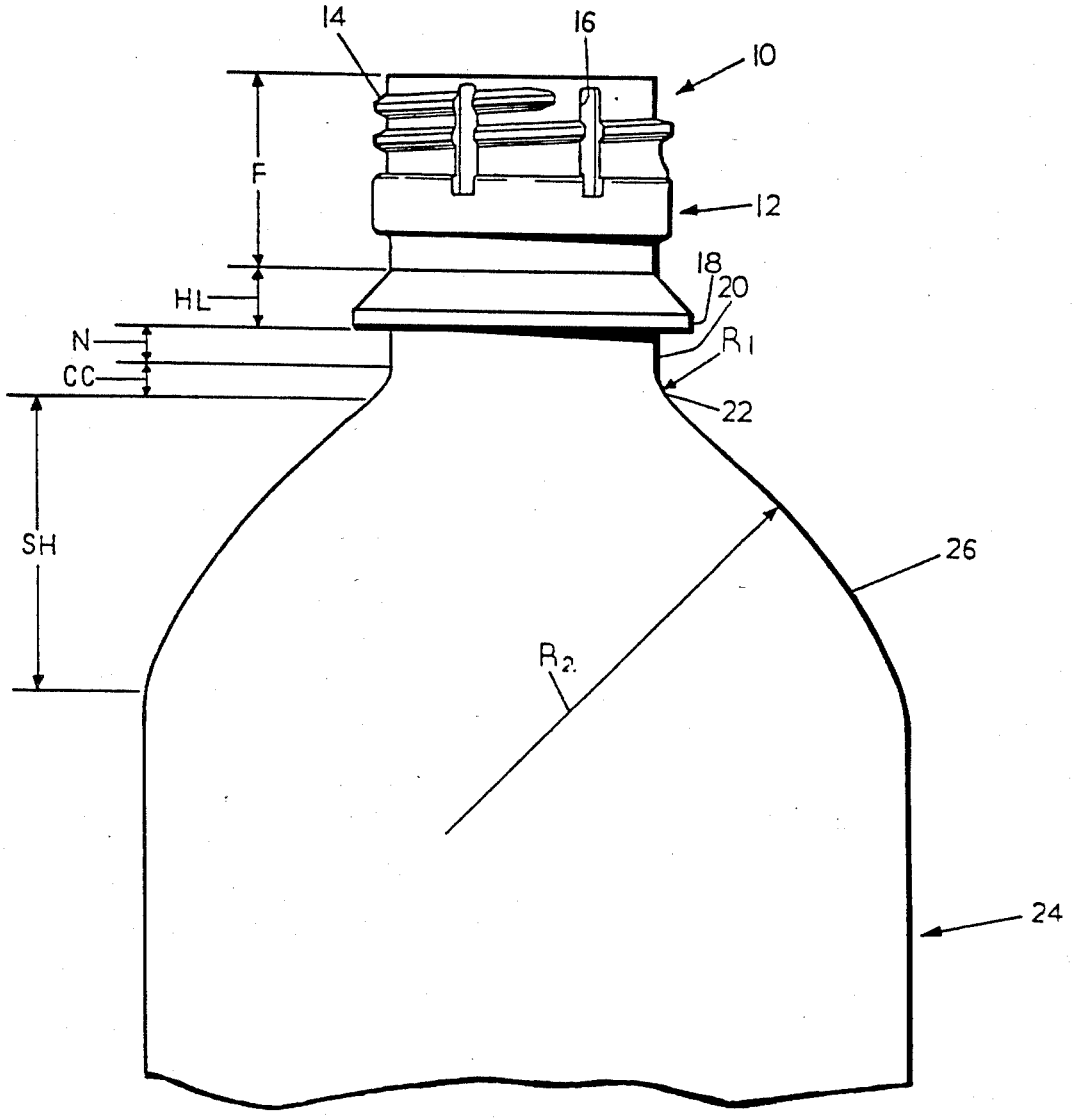
FIG. 2 is a fragmentary elevational view of a portion of the container illustrated in FIG. 1.

Referring to FIGS. 1 and 2, the invention relates to a container for holding carbonated beverages under internal pressure, such as container 10. The container 10 can be fabricated from any orientable, strain-hardenable, organic thermoplastic material, such as, for example, polyethylene terephthalate which is the preferred material. The container 10 includes a finish portion 12 having disposed on its external surface a helical thread 14. The finish portion 12 also typically includes a plurality of indwelling, vertically disposed, pressure released vent slots 16. The finish portion 12 is bounded by the distance F. An outstanding handling ledge 18 is disposed below the finish portion 12 and bounded by the distance HL.

Each of the curved arcs, represented by various radii, and the straight linear segments, represented by various distance lines, merge smoothly at their termini into one another. Such smooth blending of the termini of the various container sections provides a smooth surface for the containers, devoid of abrupt changes in the portion below the ledge 18 and includes only one void, namely, the opening in the finish 12. Disposed immediately below the outstanding handling ledge 18 is a container neck portion 20 bounded by the distance N. The neck portion 20 blends into a concave blending portion 22 which is defined by the distance CC and defined by radius line $R_1$. The concave blending portion merges with the main body of the container 24 bounded by the distance M. The main body 24 includes an upper convex shoulder portion 26 bounded by the distance SH, a main cylindrical sidewall portion 28, bounded by the distance SW, and a hemispherical spherical bottom portion 30 bounded by the distance SB completing the unitary container 10.

The shoulder portion 26 of the main body 24 is defined in its vertical demension by the distance SH. The shoulder portion 26 is further defined, in its horizontal dimension by the radius $R_2$ which defines the arc of the shoulder portion 26. Similarly, the spherical bottom portion 30 is defined by the radius line $R_3$.

The concave blending portion 22 is also defined by the radius of curvature, or so-called arc of curvature, $R_1$. As best shown at FIG. 2, the concave blending portion 22 begins at the bottom of the straight, everywhere parallel wall of neck portion 20. The concave blending portion 22 terminates where its arc of curvature, defined by radius $R_1$ intersects with the arc of curvature of the shoulder portion 26 which is defined by $R_2$.

The container according to the present invention is formed by any conventional means. For example, the container may be formed by injection molding a preform or parison of the selected organic, thermoplastic, strain-hardenable material. The parison is subsequently blow molded into the container of the present invention by conventional blow molding technology.

As used herein, the phrase "container surface area", represented by S, is defined as the outside surface area of the container including the neck portion 20, concave blending portion 22, shoulder portion 26, cylindrical sidewall portion 28, and the spherical bottom portion 30, such portions represented by the boundary areas, N, CC, SH, SW and SB, respectively. As defined herein, the phrase "container surface area", does not include the outside surface area of the finish portion 12, represented by the distance F, or the outstanding handling ledge portion 18, defined by the distance HL.

As used herein the phrase "container volume", represented by $V_c$, is defined as the volume of the container enclosed by the container neck portion 20, concave blending portion 22, shoulder portion 26, sidewall portion 28 and spherical bottom portion 30, and defined by the distances, N, CC, SH, SW and SB, respectively, The phrase "container volume" does not include any volume enclosed by the finished portion 12, represented by distance F, or the volume enclosed by the outstanding handling ledge portion 18, and defined by distance HL.

The container according to the present invention is defined in accordance with the following relationships:

(1) The surface area of the concave blending portion 22, defined by the distance CC and the radus $R_1$ is less than 5 percent and preferably less than 3 percent of the total surface area of the container 10. The reduced concave surface area of the concave blending portion 22 provides for less total surface area subject to stress induced cracking by prolonged exposure to the internal carbonation pressure in the container 10;

(2) The material distribution efficiency of the container 10, defined as "E" is equal to or greater than 0.8. The material distribution efficiency, E, can be closely approximated by the expression:

$$E = \frac{S/[W]}{\int \frac{1}{W}\, da} \geqq 0.8$$

wherein:

E is the material distribution efficiency;

S is the container surface area;

[W] is the average wall thickness of the container exclusive of the finish portion 12 and the ledge portion 18 and is equal to $V_M/S$ wherein, $V_M$ is the volume of the material of the container, usually expressed in cubic centimeter and S is the surface area defined above, usually expressed in square centimeters; and the expression:

$$\int \frac{1}{W}\, da$$

is the integration of the reciprocal of the wall thickness W over the total surface excluding the finish. The quantity can be approximated by: /

$$\sum_{i=1}^{n} \frac{\Delta a_i}{W_i}$$

which is determined by cutting numerous strips of small area, $\Delta a_i$, from a container 10 prepared according to the present invention. The integral value is determined by assuming any small strip of material has a uniform wall thickness over the surface of the strip selected such that $w_i$ is constant with the small area defined by the strip, so that the following expression mostly closely approximates the integral value of da/w. The expression for the integral value is as follows:

$$\sum_{i=1}^{n} \frac{\Delta a_i}{W_i}$$

In practice about thirty small strips of material are cut from various portions of a container 10 according to the present invention and the summation described above is conducted to determine the integral value. Generally, about thirty strips of material provides a statistically accurate value for the integral which can be used to calculate the material distribution efficiency, E.

The material distribution efficiency, E, is a measure of the uniformity of the thickness of the container, which is defined by the distances SB, SW, SH, CC, and N. Since the ledge portion 18 and the finish portion 20 are generally not effected by any blow molding operation, rather are the result of an injection molding process, they are excluded from the material distribution efficiency determination.

A container 10 according to the present invention which reaches 80 percent of the ideal 100 percent uniformity in wall thickness (i.e. E equals to or is greater than 0.80) is within the satisfactory efficiency range of the present invention. Such uniform wall thickness, when represented by the material distribution number, gives substantial uniformity of wall thickness in the above described distances SB, SW, SH, CC and N. Accordingly such high material distribution efficiency results in uniformly high orientation to the point of strain-hardening which improves gas barrier and thermal stability properties of the container 10;

(3)

$$\frac{\text{Container surface area}}{\text{Parison surface area}} > 8$$

The above surface area ratio is a measure of the degree orientation in the organic thermoplastic material from which the container 10 is fabricated. As used in the above expression, "parison surface area" is defined to be all external surface area of the parison, exclusive of the finish and ledge portions from which the container 10 is blow molded or otherwise formed. The surface area ratio defined above additionally defines the degree of orientation as it relates to the strain-hardened characteristic of the preferred material, polyethylene terephthalate, which yields substantial advantages in generating uniform wall thickness;

(4)

$$5.0 \leqq S/V_C^{\frac{2}{3}} \leqq 6.0$$

wherein $V_C$ is the container volume and S is the container surface area as defined above. The above expression is an indicator of the overall orientation of the container, below the ledge portion 18, including the degree of orientation present in the neck portion 20, concave blending portion 22, shoulder portion 24, cylindrical sidewall portion 28 and spherical bottom portion 30;

(5)

$$0.6 < D/V_C^{\frac{1}{3}} < 1.2$$

wherein D is the mean diameter of the cylindrical sidewall portion 28 of the container 10. The expression above defines, for a given volume, the degree to which te cylindrical sidewall portion approaches an ideal spherical geometry. As the sidewall section approaches spherical geometry, the surface to volume retio decreases. As the surface to volume ratio decreases the gas transmission from the enclosed pressurized contents of the container 10 through the cylindrical sidewall section 28 decreases. Thus, the above indicator is indicative of the shelf life of the product contained in the container 10;

(6)

$$\frac{V_C}{\int \frac{1}{W}\, da} > 0.03\ \text{CM}^2$$

wherein $V_C$ and the integral value are the same quantities defined hereinabove.

This quantity is a close approximation for the gas transmission rate of the container surface area and also defines product shelf life for carbonated pressurized beverages stored within the container 10, and (7)

$$V_s + V_{sw} \geqq 60\%\ \text{of the total volume excluding the finish and closure}$$

wherein $V_S$ is the volume of the spherical bottom portion of the container bounded by the distance SB and defined by $R_3$ and wherein $V_{SW}$ is the volume of the cylindrical sidewall section 28 bounded by the distance SW.

The above expression is an indicator of the degree of irregularity of the neck 20, concave blending portion 22 and shoulder portion 26 as defined by the distances N, CC and SH. The higher the degree of irregular geometry above the sidewall portion 28, defined by distance SW, the more adverse the stress distribution caused by the internal pressure for the plastic in those regions will become. This consequence lowers the thermal stability, barrier properties and shelf life for the container 10. This adversely affects the commercial usefulness of the container 10. It has been determined according to the present invention that maximum shelf life for the container 10 can be obtained by minimizing decorative designs, reinforcing ribs and the like in portions 20, 22 and 26.

In a preferred embodiment of the present invention, the material of choice is polyethylene terephthalate (PET). The plastic PET shows a dramatic strain-hardening characteristic as it reaches maximum orientation which contributes to uniform wall thickness defined herein. As the PET approaches maximum orientation, it spontaneously strain-hardens and renders the strain-hardened portion less stretchable. The portions adjacent to the strain-hardened portions, which are not maximally oriented, continue stretching and orienting to the strain-hardening point. Accordingly, when averaged over the entire container, the maximum strain-hardening effect reached at maximum orientation, contributes to uniformal thickness since the strain-hardened areas do not stretch substantially after they are strain-hardened.

In a preferred embodiment, the PET used in the invention has an inherent viscosity of about 0.73. This material is preferred because of its low cost. Also such material tends to produce less adverse taste consequences due to acetaldehyde build-up in the PET resin, than other available resins.

Further, in the present preferred embodiment of the present invention, the above-described relationships of the container 10 are as follows:

The following table gives the various characteristics and related dimensions for three sizes of containers in accordance with the present invention, wherein all lengths are inches and the container weights are in grams.

TABLE 1

| Dimension | One-Half Liter Container | One Liter Container | Two Liter Container |
|---|---|---|---|
| F | .68 | .68 | .68 |
| HL | .20 | .20 | .20 |
| N | .19 | .19 | .34 |
| CC | .11 | .15 | .28 |
| SH | 1.18 | 1.90 | 2.350 |
| SW | 3.50 | 4.23 | 5.70 |
| SB | 1.41 | 1.75 | 2.17 |
| $R_1$ | .15 | .15 | .370 |
| $R_2$ | 2.75 | 3.00 | 4.460 |
| $R_3$ | 1.41 | 1.75 | 2.17 |
| Total Weight of Container | 24 | 35 | 51 |
| Total Height of Container | 7.27 | 9.1 | 11.72 |

The container according to the present invention is lighter than commercial available comparable containers and accordingly cost less to fabricate due to reduced material use. Further, the container of the present invention achieve high efficiency of use of the plastic to give highly uniform cylindrical sidewall sections with the associated high degree of orientation, to the point of strain-hardening. Such high efficiency use of material results from increased barrier properties in the sidewall section 28 together with increased mechanical strength for the total container due to the higher degrees of orientation due to maximized strength ratios and resultant strain-harding. Also, the minimized surface area for the cylindrical sidewall section 28, which better approximates an ideal sphere than commercially available containers, results in lower gas transmission across the cylindrical sidewall section and gives higher shelf lifetimes. The container according to the present invention solves serious problems in shortened shelf life due to loss of carbonation, problems associated with stress cracking of the concave portion of the container and low mechanical strength due to ununiform orientation of the container.

In accordance with the provisions of the patent statute, I have explained the principle and mode of operation of my invention and I have illustrated and described what I consider to be the best embodiment of my invention. However, it should be understood that within the spirit and scope of the appended claims, the invention may be practiced otherwise than as I have specifically illustrated and described.

I claim:

1. A hollow oriented container formed from a parison composed of an organic, thermoplastic, strain hardenable polymeric resin, said container comprising:

a finish portion;

a finish ledge portion integral with and disposed below said finish portion;

a generally cylindrical hollow neck portion integral with and disposed below said finish ledge portion;

a concave blending portion integral with and disposed below said neck portion; and an oriented main body portion including a closed bottom portion integral with and disposed below said concave blending portion wherein said concave blending portion is less than five percent of the container surface area, the container being defined by the following relationship:

$$E \geqq 0.9$$

wherein:

$$E = \frac{S/(W)}{\int \frac{1}{W}\, da}$$

S=the container surface area (W)=average wall thickness of the container excluding the finish portion and ledge portion.

2. The container defined in claim wherein said container is defined by the following relationship:

$$\frac{\text{Container surface area}}{\text{Parison surface area}} > 8.0$$

wherein the container surface area is defined as the outside surface area of the container including the neck portion, the concave blending portion, and main body portion but not including and wherein the parison surface area is defined as the external surface area of the parison exclusive of the finish and ledge portions.

3. The container defined in claim 1 wherein said container is defined by the following relationship:

$$5 \leqq S/V_c^{\frac{2}{3}} \leqq 6$$

wherein

S=container surface area $V_c$=container volume.

4. The container defined in claim wherein said container is defined by the following relationship:

$$\frac{V_C}{\int \frac{1}{W}\, da} > 0.03\ CM^2$$

wherein:

$V_c$=container volume

W=wall thickness.

5. The container defined in claim 4 wherein said container is defined by the following relationship:

$$\frac{V_C}{\int \frac{1}{W}\, da} > 0.05\ \mathrm{CM}^2$$

6. The container defined in claim 1 wherein said main body includes:

(a) a hollow convex shoulder portion integral with and disposed below said concave blending portion;

(b) a hollow generally cylindrical side wall portion disposed below and integral with said convex shoulder portion; and (c) A hollow hemispherical bottom portion disposed below and integral with said cylindrical side wall portion.

7. The container defined in claim 6 wherein said container is defined by the following relationship:

$$0.6 \leqq D/V_c^{\frac{1}{3}} \leqq 1.2$$

wherein:

D=mean diameter $V_c$=container volume.

8. The container defined in claim 6 wherein the container is defined by the following relationship:

$$V_s + V_{sw} \geqq 0.6 V_c$$

wherein:

$V_s$=volume of the spherical bottom portion $V_{sw}$=volume of the cylindrical side wall portion.

9. The container defined in claim 1 wherein said container is made of polyethylene terephthalate.

10. The container defined in claim 1 wherein said concave blending portion is less than three percent of the container surface area.

11. A container formed from a parison of an organic, thermoplastic, polymeric material, said container comprising:

a hollow finish portion, a hollow finish ledge portion integral with and disposed below said finish portion;

a hollow generally cylindrical neck portion integral with and disposed below said finish ledge portion;

a hollow concave blending portion integral with and disposed below said neck portion;

a hollow convex shoulder portion integral with and disposed below said concave blending portion;

a hollow generally cylindrical side wall portion disposed below and integral with said convex shoulder portion, the container being defined by the following relationship:

$$E \geqq 0.9$$

wherein:

$$E = \frac{S/(W)}{\int \frac{1}{W}\, da}$$

S=the container surface area (W)=average wall thickness of the container excluding the finish portion and ledge portion;

and a hollow hemispherical bottom portion disposed below said cylindrical sidewall portion and integral therewith, wherein the dimensions of said container are determined in accordance with the following relationships:

(a) the area of said concave blending portion is less than five percent of the container surface area;

(b)

$$5 \leqq S/V^{\frac{2}{3}} \leqq 6$$

wherein:

S=container surface area

V=container volume (c)

$$0.6 < D/V_c^{\frac{1}{3}} < 1.2$$

wherein:

D=mean diameter $V_c$=container volume (d)

$$\frac{V_C}{\int \frac{1}{W}\, da} > 0.03\ \mathrm{CM}^2$$

wherein:

$V_c$=container volume

W=wall thickness.

* * * * *